United States Patent [19]

Dyck et al.

[11] Patent Number: 4,527,067

[45] Date of Patent: Jul. 2, 1985

[54] CONCRETE SHIELDING HOUSING FOR RECEIVING AND STORING A NUCLEAR FUEL ELEMENT CONTAINER

[75] Inventors: Hans-Peter Dyck, Burgdorf; Harry Spilker, Bad Muender; Heinz-Dieter Gregor, Hanover, all of Fed. Rep. of Germany

[73] Assignee: Deutsche Gesellschaft für Wiederaufarbeitung von Kernbrennstoffen mbH, Hanover, Fed. Rep. of Germany

[21] Appl. No.: 437,748

[22] Filed: Oct. 29, 1982

[30] Foreign Application Priority Data

Nov. 5, 1981 [DE] Fed. Rep. of Germany ..... 3144114

[51] Int. Cl.[3] ..... G21F 5/00

[52] U.S. Cl. ..... 250/507.1; 250/506.1; 252/633

[58] Field of Search ..... 250/506.1, 507.1; 252/626, 633

[56] References Cited

FOREIGN PATENT DOCUMENTS 2091477A 7/1982 United Kingdom ..... 252/633

OTHER PUBLICATIONS

Nelson et al., "Retrievable Surface Storage Facility . . . ", *Nuclear Technology,* vol. 24, Dec. 1974, pp. 391-397.

*Primary Examiner*—Alfred E. Smith
*Assistant Examiner*—Jack I. Berman
*Attorney, Agent, or Firm*—Walter Ottesen

[57] ABSTRACT

The invention is directed to a concrete shielding housing for receiving and storing a transportable fuel element container which is suitable for storage and filled with spent nuclear reactor fuel elements. The clear interior dimensions of the concrete shielding housing are somewhat larger than the outer dimensions of the container. At least one air inlet opening is provided at the lower region of the concrete shielding housing and, at the highest location of the housing, there is provided an air outlet opening. The air outlet opening is covered by means of a roof-like cover arranged in spaced relationship to the concrete shielding housing. The air outlet opening is surrounded by plates or metal strips or the like which are securely mounted to the housing and extend upwardly in the direction perpendicular to the housing. The upper edge of these plates terminate at a small distance from the roof-like cover. The air stream escaping from the interior of the housing is guided through a labyrinth-like path to the ambient.

4 Claims, 1 Drawing Figure

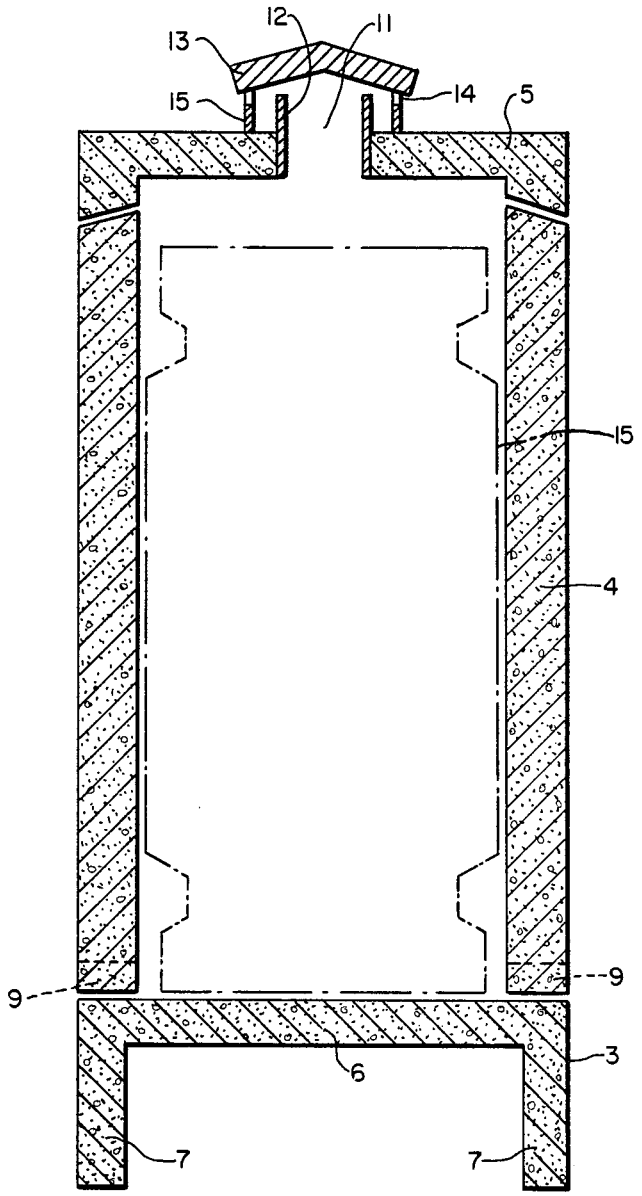
12
11
13
15
14
5
15
4
9
9
3
6
7
7

CONCRETE SHIELDING HOUSING FOR RECEIVING AND STORING A NUCLEAR FUEL ELEMENT CONTAINER

FIELD OF THE INVENTION

The invention relates to a concrete shielding housing for receiving and storing a fuel element container filled with spent nuclear reactor fuel elements. The container is suitable for transport and storage. The clear inner dimensions of the concrete shielding housing are somewhat larger than the outer dimensions of the fuel element container. The lower region of the concrete shielding housing has at least one air inlet opening and, at the highest point of the housing, there is provided an air outlet opening. The air outlet opening is covered by a cover which is arranged in spaced relationship to the housing.

BACKGROUND OF THE INVENTION

In efforts to provide a temporary storage for fuel element containers in the open, it has been suggested to accommodate the containers in a silo-like housing made of concrete or steel-reinforced concrete. The silo-like housing can be of different configurations and each are suitable for accommodating one fuel element container. In one configuration of the shielding housing for receiving fuel element containers, the shielding housing is provided with lateral air passages at the lower end of the concrete shielding wall and lateral air outlet passages in the region of the upper end of the shielding wall beneath the cover. With this arrangement of the air inlet and air outlet openings, a natural convection within the housing is obtained for directing away the heat produced by the radioactive decay of materials stored in the container.

It is necessary especially for the upper air outlet opening to take measures which will prevent the penetration of rainwater into the housing. For this purpose, the air outlet opening is covered. If a central air outlet opening is provided at the highest location of the concrete shielding housing, it is advantageous to provide a roof-like cover over the air outlet opening and arrange this cover so that it is in a spaced relationship to the concrete shielding housing.

SUMMARY OF THE INVENTION

It is an object of the invention to provide a concrete shielding housing of the type referred to above wherein an improved shielding of the housing against the penetration of water and snow is obtained.

The concrete shielding housing according to the invention includes a base and a concrete shielding body mounted on the base. Air inlet means are provided at the lower region of the housing for admitting air into the interior thereof and air outlet means are provided at the highest location of the shielding body for venting air from the interior of said housing. According to a feature of the invention, a cover is arranged over the air outlet means so as to be in spaced relationship to the shielding body. Baffle means are mounted on the shielding body in surrounding relationship to the air outlet means and extend upwardly from the shielding body toward the cover.

The air outlet means recited above can be an air outlet formed in the shielding body at the highest location thereof. The baffle means then can be in the form of plates arranged in surrounding relationship to the opening and can extend upwardly toward the cover in the vertical direction. The vertical dimension of the plates is selected so that the upper edge thereof and the cover conjointly define a gap therebetween to permit the passage of vented air therethrough.

The roof-like cover extends over the air outlet opening arranged at the highest location of the concrete shielding housing. The arrangement of the vertical plates around the air outlet opening achieves a labyrinth-like throughflow of the air stream escaping from the interior of the housing. The combination of the roof-like cover and the vertical plates provides an increased protection against driving rain.

According to another feature of the invention the cover arranged about the air outlet opening has an outermost periphery and an apex. The surface of the cover is inclined downwardly from the apex to this outermost periphery. The downwardly-sloping inclination of the roof-like cover to its sides in combination with the vertical plates provide a good protection against heavy rain even when bad weather conditions obtain and rain impinges upon the concrete shielding housing from the side.

BRIEF DESCRIPTION OF THE DRAWING

The drawing shows an elevation view, in section, of the concrete shielding housing of the invention. The drawing also depicts a fuel element container in phantom outline disposed therein.

DESCRIPTION OF THE PREFERRED EMBODIMENTS OF THE INVENTION

The concrete shielding housing includes a pallet-like base 3 upon which is placed a cylindrical concrete shielding wall 4. A cover 5 forms part of the housing and lies upon the concrete shielding wall 4. The shielding wall and cover can be viewed as being a concrete shielding body mounted on the base.

The base 3 includes a square base plate 6 having feet 7 mounted at respective corners thereof so that the base 3 is configured as a pallet accessible from beneath for moving the same from one location to another. The cylindrically-formed concrete shielding wall 4 is placed upon the base 3 and is aligned by means of a suitable centering arrangement (not shown).

Axial bores can be provided in the concrete shielding wall which are not shown in the drawing. These bores are filled with neutron shielding material which can, for example, be made of rods of synthetic material.

The concrete shielding wall 4 is provided with recesses 9 at its lower end which serve as air inlet passages. The cover 5 lying on top of the concrete shielding wall 4 has an air outlet opening 11 at its center. The air outlet opening 11 is surrounded by plates 12 which extend upwardly in the direction perpendicular to the cover 5. The plates 12 are securely mounted to the cover 5 of the concrete shielding housing. A roof-like cover 13 is arranged over the air outlet opening 11 and is secured to the concrete shielding housing by means of four posts which are perpendicular to the cover 5 and extend upwardly. The roof-like cover 13 has a slope which falls downwardly from its center to its peripheral sides. The area covered by a vertical projection of the cover 13 is greater than the air outlet opening 11. Splash plates 15 are arranged between each two adjacent ones of the posts 14 and extend upwardly a distance halfway between the cover 5 and the roof-like cover 13.

The fuel element container 15 is shown in phantom outline as standing upright upon the base plate 6 of the base 3.

When the fuel element container 15 is delivered to the temporary storage facility it is placed upon the base plate 6 of the base 3. Thereafter, the concrete shielding wall 4 is placed over the container 15 so that it too rests upon the base 3. Finally, the cover 5 is placed on the upper free end of the concrete shielding wall 4.

Because of the heat produced by the radioactive decay of the nuclear reactor fuel elements, the air in the concrete shielding housing becomes heated. The warm air then vents via the air outlet opening 11. Fresh air enters the concrete shielding housing through the air inlet openings 9 arranged at the lower region of the housing. In this way, a chimney effect is obtained. This natural ventilation serves to remove the heat developed by the radioactive decay. The air escaping out of the air outlet opening 11 is forced to the side and over the surrounding metal strips 12 by the roof-like cover 13. The air stream escapes from the interior housing via a labyrinth-like passage. Heavy rains which impinge upon the housing from the side cannot penetrate the air outlet opening 11 of the housing because of the labyrinth-like covering of this opening 11.

Other modifications and variations to the embodiments described will now be apparent to those skilled in the art. Accordingly, the aforesaid embodiments are not to be construed as limiting the breadth of the invention. The full scope and extent of the present contribution can only be appreciated in view of the appended claims.

What is claimed is:

1. A concrete shielding housing for receiving and storing a transportable fuel element container which is suitable for storage and filled with spent nuclear reactor fuel elements, the housing comprising:

a base; and a concrete shielding body mounted on said base;

the clear interior dimensions of the housing being somewhat greater than the outer dimensions of the container;

air inlet means at the lower region of the housing for admitting air into the interior thereof:

air outlet means at the highest location of said shielding body for venting air from the interior of said housing;

a cover arranged over said air outlet means so as to be in spaced relationship to said shielding body; and, labyrinth baffle means disposed in surrounding relationship to said air outlet means for conducting the air vented through said air outlet means along a labyrinth-like path to the ambient.

2. The concrete shielding housing of claim 1, said air outlet means being an air outlet opening formed in said shielding body at the highest location thereof; and said baffle means being plates surrounding said opening and extending upwardly toward said cover in the vertical direction, the vertical dimension of said plates being selected so that the upper edge thereof and said cover conjointly define a gap therebetween to permit the passage of vented air therethrough.

3. The concrete shielding housing of claim 2, said cover having an outermost periphery and an apex, the surface of said cover being inclined downwardly from said apex to said outermost periphery.

4. The concrete shielding housing of claim 3 comprising: a plurality of legs for supporting said cover in spaced relationship to said shielding body, and said baffle means including respective splash plates arranged between each two mutually adjacent ones of said legs.

* * * * *